United States Patent [19]

Meinander

[11] Patent Number: 4,889,073

[45] Date of Patent: Dec. 26, 1989

[54] METHOD AND APPARATUS FOR COATING A WEB

[75] Inventor: Paul O. Meinander, Grankulla, Finland

[73] Assignee: Valmet Paper Machinery Inc., Helsinki, Finland

[21] Appl. No.: 822,430

[22] PCT Filed: Apr. 4, 1985

[86] PCT No.: PCT/FI85/00037

§ 371 Date: Dec. 17, 1985

§ 102(e) Date: Dec. 17, 1985

[87] PCT Pub. No.: WO85/04824

PCT Pub. Date: Nov. 7, 1985

[30] Foreign Application Priority Data

Apr. 17, 1984 [FI] Finland ..... 841533

[51] Int. Cl.[4] ..... B05D 3/12

[52] U.S. Cl. ..... 427/356; 118/103; 118/119; 118/411; 118/413; 118/414

[58] Field of Search ..... 118/103, 413, 411, 405, 118/414, 119, 101; 427/356

[56] References Cited

U.S. PATENT DOCUMENTS

| | | | |
|---|---|---|---|
| 2,946,307 | 7/1960 | Warner | 118/414 X |
| 3,257,226 | 6/1966 | Thwaites | 118/101 X |
| 3,863,597 | 6/1975 | Anselrode | 118/126 |
| 4,063,531 | 12/1977 | Zitzow | 118/122 |
| 4,231,318 | 11/1980 | Zink | 118/122 |
| 4,233,930 | 11/1980 | Wohfeil | 118/122 |
| 4,250,211 | 2/1981 | Damrau et al. | 118/413 X |
| 4,367,691 | 1/1983 | Bergs | 118/119 |
| 4,558,658 | 12/1985 | Sommer et al. | 118/413 X |

FOREIGN PATENT DOCUMENTS

| | | | |
|---|---|---|---|
| 1964908 | 8/1970 | Fed. Rep. of Germany | 118/414 |
| 2034004 | 1/1972 | Fed. Rep. of Germany . | |
| 2845036 | 4/1980 | Fed. Rep. of Germany . | |
| 301287 | 5/1968 | Sweden . | |
| 348777 | 9/1972 | Sweden . | |
| 356443 | 5/1973 | Sweden . | |
| 7509460-7 | 7/1982 | Sweden . | |
| 7813128-1 | 5/1983 | Sweden . | |
| 8401034-7 | 9/1984 | Sweden . | |
| 7712089-7 | 2/1985 | Sweden . | |
| 2085327 | 4/1982 | United Kingdom | 118/122 |
| 2091598 | 8/1982 | United Kingdom | 118/405 |

*Primary Examiner*—Shrive Beck
*Assistant Examiner*—Alain Bashore
*Attorney, Agent, or Firm*—Nixon & Vanderhye

[57] ABSTRACT

A method and apparatus for two-sided coating of a moving web, e.g. a paper web, and smoothing said coating. The direction of movement of the web (4) is substantially upwards. The web is fed through a coating chamber (3) and the coating is immediately smoothed in the top part of the chamber. The top of the chamber is formed by a flexible blade (5) and a rod (6) mounted rotatably on bearings, the blade and the rod forming a nip (7) where the coating is smoothed while the web passes through it. The nip is mounted at a short distance from the coating channel outlets (2).

8 Claims, 2 Drawing Sheets

METHOD AND APPARATUS FOR COATING A WEB

TECHNICAL FIELD

The present invention relates to a method and an apparatus for applying a coating and smoothing it on both sides of a web, e.g. a paper web, the direction of which is substantially upwards.

BACKGROUND ART

The operation of a conventional blade coating unit is single-sided against a roll. This causes the paper composition to be non-symmetric which results in curling of the paper after drying. Since only one side of the paper is coated at a time both-sided coating requires two separate coating units which of course makes the apparatus complex and expensive and reduces its controllability during operation. A hole in the paper stains the roll which breaks the web as paper adheres to the roll during the next revolution. In a conventional blade coater, coating slip is applied and smoothed by a blade separately. Between these phases the paper web absorbs water and binding agents from the slip whereby it is difficult to regulate the composition of the coating slip, furthermore the paper web is wetted, it swells and its quality thus decreases.

A Billblade coater (Deutsches Papierwirtschaft 1981/3, pages 162–164) provides a method for two-sides coating, which eliminates the problem of curling of the paper. One of the drawbacks of the Billblade method, however, is that the quality of the coating is not adequate for high-quality products. The quality of the coating is decreased as coating of the other side of the web is carried out against a roll and the coating film formed between the roll and the paper web must be split and the smoothness of the coating layer thus disturbed. In a Billblade coater the web is drawn downwards and as no dryers can be installed under the coater because of dirty conditions, the web must be drawn largely free into the first dryer. This results in instability of the web and difficulties in running. In the Billblade process the web is drawn through a vessel due to which the viscosity range is limited. High solids contents can not be used in the Billblade process. The geometry of the Billblade process in two-sided coating is non-symmetric due to the form of the gap and the rotation of the roll, which pumps slip to the roll side.

The drawbacks of the Billblade process have been suggested to be avoided, e.g. by the Twinblade by Inventing (Deutsche Papierwirtschaft 1981/3, pages 162 to 164). In the Twinblade the web runs upwards to a coating unit where excess amounts of slip is applied onto the web by special applicators after which the web continues its travel (apprx. 50 cm) upwards to a nip of opposing blades where excess slip is removed by a doctor. One of the disadvantages of the Twinblade is that the web is excessively wetted during the long contact of the web with the coating slip between the applicators and the blades. This weakens the web in particular in case of thin paper grades and results in swelling of the web and problems in running. As Twinblade employes two blades installed against each other the geometry is extremely sensitive to the position of the blades and even the slightest wearing of the blades or bending of the blade beams result in crucial changes in the geometry. Therefore the coating process is in practice very difficult to control. Furthermore, positioning the blades at a distance from the coating slip applicators affects the coating quality, blows cause holes in the slip layer.

To improve conventional one-sided coating, so-called short-dwell coaters have been developed (Das Papier 37, 1983, no. 7, pages 303 to 305), where the coating slip is fed into the blade gap. The paper and the slip are in contact with each other only a short time (<10 cm) before the slip is smoothed. This has been found to improve the running properties of the web and controllability of the coating process.

A Finnish patent application, no. 803184, discloses a coater where the web runs in a vertical direction upwards from the nip of a short-dwell type coating unit and a roll. Coating slip is provided onto the roll side by a separate applicator as close to the roll as possible and excess slip is returned down towards the applicator.

This method, however, has some drawbacks, e.g. the long contact time of the paper and the slip on the roll side; most of the slip flowing in with the paper is returned to the roll side which creates turbulence; the roll pumps coating slip to the smoothing gap of the coater and the coating film is splitted on the roll side.

In addition to the above basic coater applications there are several variant modifications available, which are more or less strained by the handicaps discussed above.

DISCLOSURE OF THE INVENTION

It is an object of the present invention to avoid the above handicaps in the coating process and

- to achieve short and equal contact time of the coating slip and the web on both sides before the slip is smoothed and thus
  - avoid excess wetting of the web, and curling
  - minimize the change in the solids content of the slip before smoothing
  - achieve good and controlled running properties and stable smooth coating
- to achieve symmetric coating
- to avoid splitting of the film
- to provide a coating method which is not sensitive to wearing of the blade
- to achieve blade geometry which is easy to regulate
- to provide a web running upwards and thus
  - a device which is easy to observe and
  - easy to clean and
  - make possible the use of a simple dryer application.

The method according to the invention is characterized by the feature that the web is fed through a coating chamber and the coating slip is immediately smoothed in the nip between a rotating rod and a flexible blade. The apparatus according to the invention is characterized by the feature that the top of the closed coating chamber is formed by a nip between a rod mounted rotatingly on bearings and having a round cross-section, and a flexible blade disposed against the rod, both mounted transversely to the web at a short distance from the outlets of the coating channels, said nip smoothing the coating of the web while the web passes though it.

As the coating layer is smoothed immediately after application no water is absorbed from the slip to the web to degrade the web and/or the coating. As the smoothing members are placed in connection with the coating chamber and the coating chamber is substantially filled with coating slip no blows are created in the slip which would cause unevenness or non-uniformity of the coating layer.

A rotating rod of suitable size and a flexible adjustable counter blade provide a symmetric coating process and and a blade geometry easy to regulate. Since the blade is easy to adjust against the rod, wearing of the blade does not problems in controlling the coating geometry.

By rotating the rod in a direction opposite to the direction of the web at a velocity which does not affect the dynamics of the nip between the blade and the rod, the web always leaves a clean rod surface and unevenness is avoided which could arise if the web left a rod covered with coating slip.

In an embodiment where the rod is rotated in the direction of the web travel at a remarkably higher velocity, e.g. 2000 1/min, than the web good coating is achieved under certain conditions.

According to an advantageous embodiment the rod is provided with glide bearings and its diameter is preferably 20 to 200 mm. If nesessary the rod can be tubular and e.g. filled with water.

BRIEF DESCRIPTION OF THE DRAWINGS

The invention is described in detail below with reference to the accompanying drawings in which.

BEST MODE OF CARRYING OUT THE INVENTION

Figure 1:
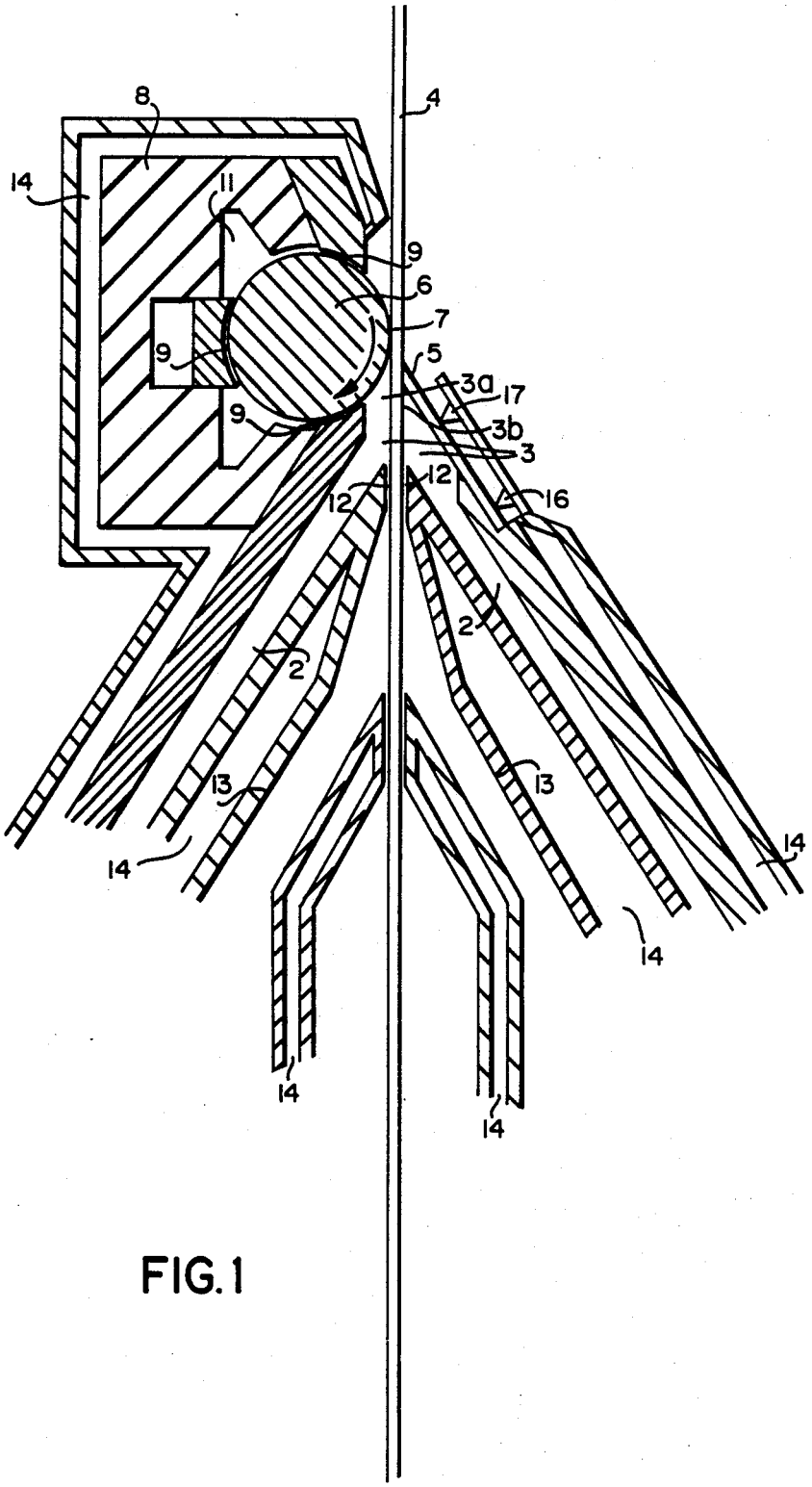
FIG. 1 is a cross section of an advantageous embodiment for carrying out the method of the invention.
Figure 2:
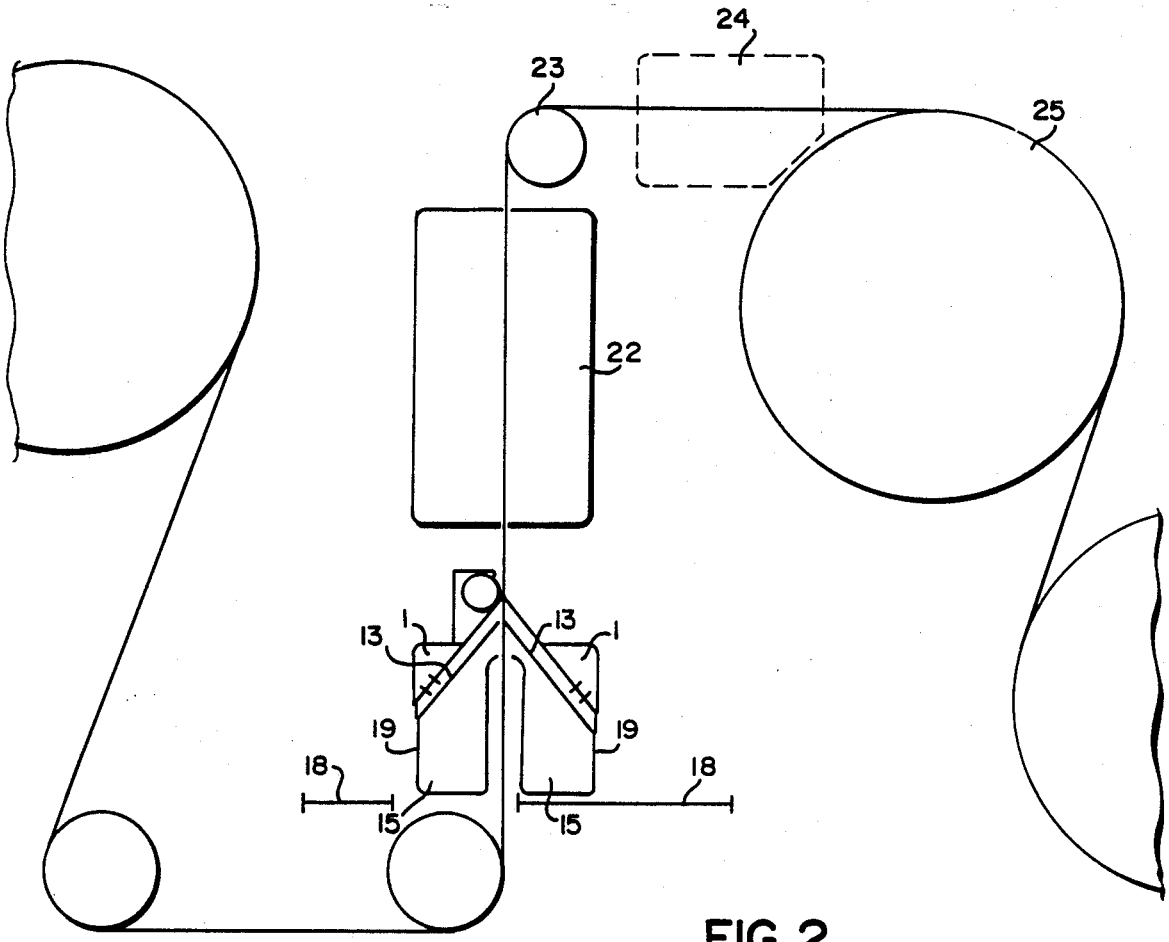
FIG. 2 is a schematic illustration of the travel of the web in a coating unit according to the invention and of a position of operating platforms.
Figure 3:
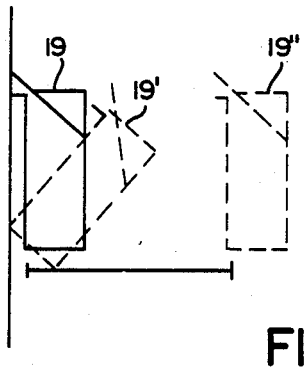
FIG. 3 is a schematic illustration of a position of the blade beam in connection with cleaning and blade replacement

In the coating devices illustrated in the figures coating slip is introduced through applicator bars 1 into coating channels 2, which may contain built-in elements to even the slip flow. The slip flows into a coating chamber 3 through which paper web 4 runs. The outlet side of the coating chamber is defined by a coating blade 5 and a rod 6. The curvature of the rod 6 casing is dimentioned to approximately coincide with the bending of the coating blade 5; thus coating chambers 3*a* and 3*b* are nearly symmetric at the nip 7 between the blade and the rod. The diameter of the rod 6 is 2 to 20 cm. The rod is provided with a known driving device which is not illustrated here. In an advantageous embodiment the rod 6, supported by a roll holder formed by a beam 8 into which members provided with glide bearing surfaces 9 are attached, rotates in the opposite direction compared to the direction of the web 4. In order to clean the rod 6 and to lubricate the glide bearing surfaces, liquid, e.g. water, can be fed into chamber 11.

The excess coating slip brought into chamber 3*a* and 3*b* extrudes through slots 12 the width of which can be adjusted so as to create a light overpressure in the coating chamber which prevents air from flowing into the coating chamber 12 with the web. The lower walls 13 of the coating channels are placed in a position where the surface tension causes the excess slip to run from the slots 12 down along the lower walls surfaces. In order to facilitate cleaning of the device its surfaces are substantially cooled by cooling water chambers 14.

The excess slip runs into slip collectors 15 which are arranged to make the flow as even as possible to prevent air from being mixed into the slip. From the collectors the slip is recycled into the slip circulation of the coater.

The rod can be tubular and filled with water in order to facilitate cleaning. Blade holder 16 and positioner 17 can vary according to the present and future construction alternatives.

Compared with all the blade coaters available today the present invention provides the advantage that the blade angle against the rod and the take-off angle of the web are easy to adjust by moving the blade beam in vertical and horizontal direction.

In order to facilitate attendance of the coating device it is built so narrow and high that the operating personnel easily reaches the coating blade 5 and standing on platform 18 can see the coated web. Blade beam 19 which constitutes the whole blade side of the coating unit is fixed so as to be easily placed in position 19' for blade replacement and in position 19'' for a more extensive wash and service, whereby the the rod side beam can be reached from the platform 18.

Drying units 22 may be arranged after the coating device which can be infra-red air-foil dryers or other applications which do not touch the web. Web guide 23 can be a roll guide or, if the web sticks to the roll and a roll can not therefore be used, e.g. an air-cushion guide or other similar device. Additional dryers of different types and lenghts can of coarse be used before a conventional drying section 25.

The invention is not limited to the presented embodiments. Several modifications may be made of it within the scope of the inventive idea defined by the patent claims.

E.g. the rotating rod can be mounted on separate bearings disposed at a distance from each other in the width direction of the rod. In this case, other type of bearings can be used than glide bearing. Slip and water which is eventually used can be removed from the rod by a doctor or by any other known method.

I claim:

1. A method for symmetrical two-sided coating and smoothing said coating of a moving web, e.g., a paper web, the direction of movement of which is substantially upwards, which method comprises feeding the web through a closed coating chamber; and smoothing the coating immediately thereafter by passing the web through an outlet of the chamber, which outlet comprises a nip formed by a flexible blade and a round rod rotatably mounted on bearings adapted to support it along its length; and rotating said rod against the direction of movement of the web.

2. An apparatus for symmetrical two-sided coating and smoothing said coating of a web, e.g. a paper web, the direction of movement of which is substantially upwards, comprising a closed coating chamber the lower part of which is connected to outlets of coating channels and the upper part of which is formed by a round rod rotatably mounted on bearings adapted to support said rod along its length, the rotation being against the direction of movement of the web, and a flexible blade, both positioned transversely to the web at a short distance from the outlets of the coating channels.

3. An apparatus as recited in claim 2 wherein the rod is mounted on glide bearings.

4. An apparatus as recited in claim 2 or 3 wherein the rod is mounted on bearings along its whole length.

5. An apparatus as recited in claim 2 wherein the curvature of the rod coincides with the curvature of the blade.

6. An apparatus as recited in claim 2 wherein the diameter of the rod is 20 to 200 mm.

7. An apparatus as recited in claim 2 provided with a driving device which rotates the rod against the direction of movement of the web.

8. An apparatus as recited in claim 3 wherein the rod is mounted on bearings along its whole length.

* * * * *